United States Patent [19]

Okamoto et al.

[11] Patent Number: 4,798,970

[45] Date of Patent: Jan. 17, 1989

[54] DEFROSTING CIRCUIT SWITCH UNIT FOR ELECTRONIC RANGE

[75] Inventors: Kenzo Okamoto, Osaka; Fumihiko Kitada, Neyagawa, both of Japan

[73] Assignee: Imanishi Kinzoku Kogyo Kabushiki Kaisha, Osaka, Japan

[21] Appl. No.: 137,211

[22] Filed: Dec. 22, 1987

[30] Foreign Application Priority Data

Dec. 24, 1986 [JP] Japan ..... 61-197345

[51] Int. Cl.[4] ..... H01H 43/00

[52] U.S. Cl. ..... 307/119; 307/141; 219/10.55 B; 219/10.55 C; 200/37 A; 200/35 R

[58] Field of Search ..... 307/112, 119, 141, 141.4, 307/141.8, 132; 200/11 R, 11 DA, 11 G, 11 TW, 37 A, 38 R, 38 B, 38 C, 38 F, 38 FA, 35 R; 219/10.55 R, 10.55 B, 10.55 C

[56] References Cited

U.S. PATENT DOCUMENTS 4,523,062 6/1985 Mahon ..... 200/35 R
4,629,845 12/1986 Mahon ..... 219/10.55 C X
4,697,057 9/1987 Fowler ..... 200/37 A

*Primary Examiner*—Willaim M. Shoop, Jr.
*Assistant Examiner*—Paul Ip
*Attorney, Agent, or Firm*—Armstrong, Nikaido, Marmelstein & Kubovcik

[57] ABSTRACT

A defrosting circuit switch unit for an electronic range comprises: a frame of said unit, said frame being provided with a shaft; a defrosting circuit switch lever provided in a case in which a time switch is incorporated; a connecting rod having its lower end portion connected with a free end portion of said lever, said connecting rod being slidably moved up and down; a rotary plate rotatably mounted on said frame through said shaft and provided with a stopper extending in a projecting manner, said stopper being received in an elongated hole of an upper portion of said connecting rod, said rotary plate being integrally formed with a projection and a sector cam, said projection abutting on a leaf spring mounted on said frame; and a tension spring mounted between said rotary plate and said frame so as to resiliently biasing said rotary plate, said tension spring being engaged with said rotary plate through an engaging hole provided in said rotary plate.

1 Claim, 5 Drawing Sheets

FIG. 9
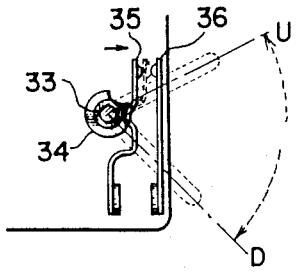
FIG. 7
FIG. 6
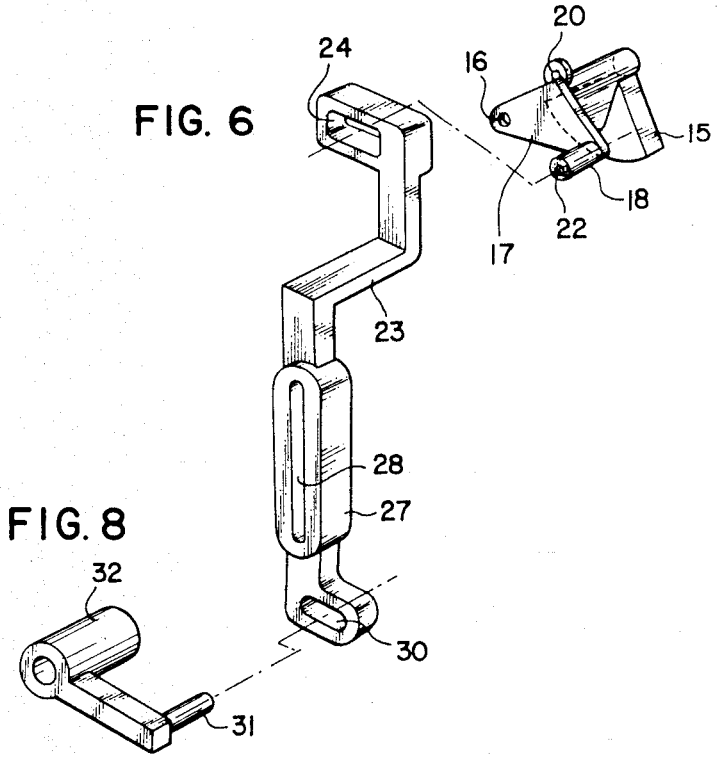
FIG. 8

DEFROSTING CIRCUIT SWITCH UNIT FOR ELECTRONIC RANGE

BACKGROUND OF THE INVENTION

1. Field of the Invention

The present invention relates to a defrosting circuit switch unit for an electronic range, and more particularly to such a defrosting circuit switch unit housed in a case and in which unit is incorporated a time switch for the electronic range necessary for heat-cooking a frozen food having been defrosted in the electronic range.

2. Description of the Prior Art

In the past, there is not provided an electronic range in which a defrosting circuit switch unit is incorporated in a synthetic resin case housing a time switch for cooking use so as to save space and minimize the number of component parts of the electronic range to simplify its construction and its assembling work. In a conventional electronic range, there is not provided a defrosting circuit switch unit which makes it possible that a time switch for presetting a cooking time interval can also serve as a time switch for presetting a defrosting time interval.

SUMMARY OF THE INVENTION

It is an object of the present invention to provide a defrosting circuit switch unit for an electronic range comprising: a frame of said unit, said frame being provided with a shaft; a defrosting circuit switch lever provided in a case in which a time switch is incorporated; a connecting rod having its lower end portion connected with a free end portion of said lever, said connecting rod being slidably moved up and down; a rotary plate rotatably mounted on said frame through said shaft and provided with a stopper extending in a projecting manner, said stopper being received in an elongated hole of an upper portion of said connecting rod, said rotary plate being integrally formed with a projection and a sector cam, said projection abutting on a leaf spring mounted on said frame; and a tension spring mounted between said rotary plate and said frame so as to resiliently biasing said rotary plate, said tension spring being engaged with said rotary plate through an engaging hole provided in said rotary plate.

The circuit switch unit for the electronic range of the present invention is characterized in that: the defrosting circuit switch unit is provided in the synthetic resin case in which the time switch for cooking use is housed, so as to save space and minimize component parts of the electronic range to simplify the range in its construction and assembling work in manufacturing thereof and further to make its switching operation easy.

In the circuit switch unit for the electronic range of the present invention, a time switch for presetting a cooking time interval can also serve as a time switch for presetting a defrosting time interval. Consequently, it is possible that the time switch for selecting the duration of the time interval during which the microwave energy generated by the magnetron is supplied to the cooking chamber of the range is intermittently operated so as to defrost the frozen food in a short time and heat-cook the thus defrosted food.

As described above, in the circuit switch unit for the electronic range of the present invention, the time switch for presetting the cooking time interval also serves as the time switch for presetting the defrosting time interval to make the operation of the electronic range in use simple. In addition, such electronic range is excellent in safety and durability, and suitable in mass production thereof.

BRIEF DESCRIPTION OF THE DRAWINGS

FIG. 6 is an enlarged perspective view of the connecting rod of the circuit switch unit of the present invention;

FIG. 7 is an enlarged perspective view of the rotary plate of the circuit switch unit of the present invention;

FIG. 8 is an enlarged perspective view of the lever of the circuit switch unit of the present invention; and FIG. 9 is a partially enlarged view of the contact plates of the circuit switch unit of the present invention.

DESCRIPTION OF THE PREFERRED EMBODIMENT

An embodiment of the present invention will be hereinbelow described with reference to the drawings. However, it is clear that the present invention is not limited to such embodiment.

Figure 1:
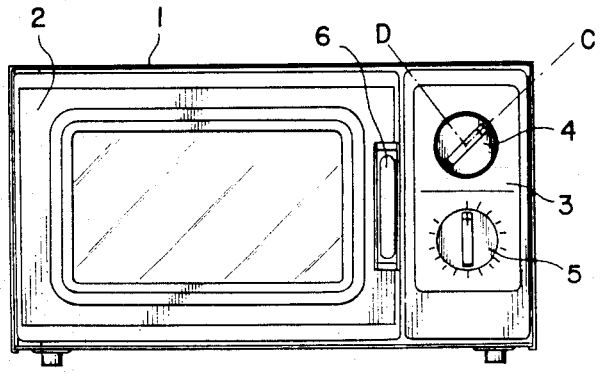
FIG. 1 is a front view of the entire electronic range of the present invention.

FIG. 1 is a front view of an electronic range in which is incorporated a defrosting circuit switch unit of the present invention. A main body 1 of the electronic range of the present invention is provided with a door 2 which is hinged on a front portion of the main body 1 of the range. Adjacent to the door 2 in the right-hand side is a switch panel 3 in an upper portion of which is provided a knob 4 for operating a defrosting switch. Under the knob 4 is provided a knob 5 for operating a time switch for presetting a cooking time interval, in the switch panel 3. The door 2 of the range is provided with a grip 2 through which the user opens the door 2 and takes the cooked food out of a cooking chamber of the range.

Figure 2:
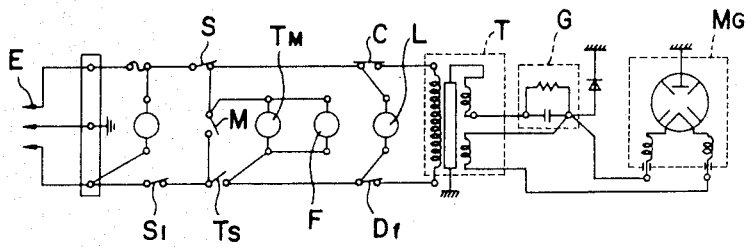
FIG. 2 is an internal electric circuit diagram of the electronic range of the present invention.

In FIG. 2, there is shown an example of an internal electric circuit diagram of the entire electronic range of the present invention in which: the reference character "E" denotes an electric power source; "S" and "S." electric power switches; "TS" a time switch (motor-drive type); "F" a cooling fan motor; "TM" a timer motor; "L" an illumination light; "T" a high-tension transformer., "MG" the magnetron for generating the microwave energy; and "G" a capacitor for applying a high voltage to the magnetron "MG".

Figure 3:
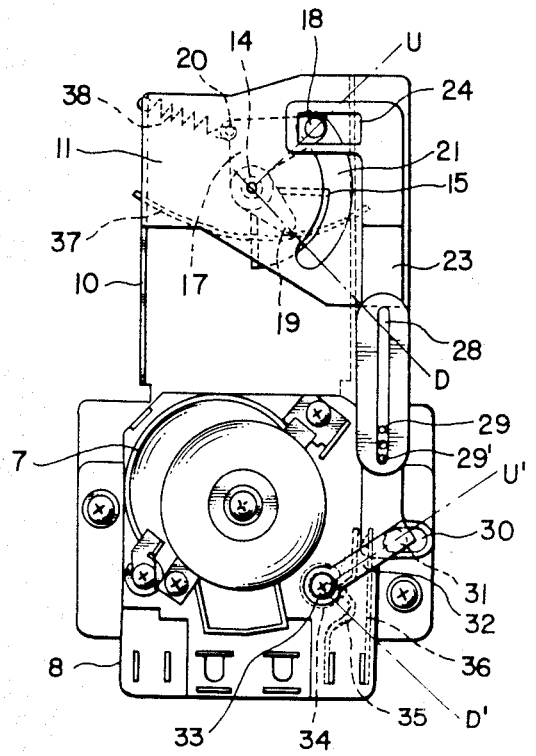
FIGS. 3 and 4 are rear views of an essential part of the circuit switch unit for the electronic range of the present invention.
Figure 4:
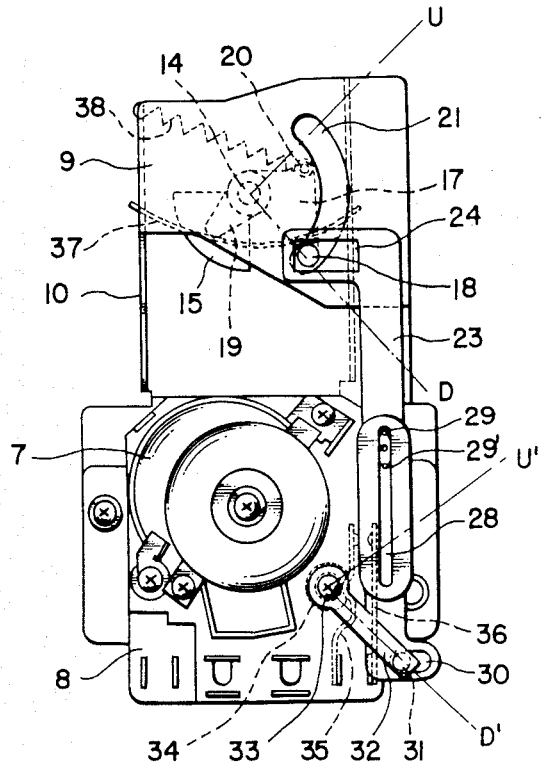
Figure 5:
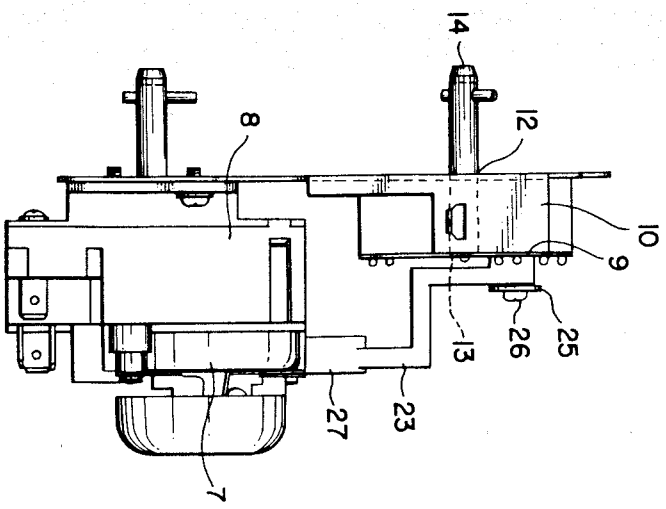
FIG. 5 is a side view of the essential part of the circuit switch unit for the electronic range of the present invention.

An internal mechanism of the time switch "TS" for presetting the cooking time interval is shown in FIGS. 3 to 5. In such time switch "TS", a motor timer 7 is housed in a synthetic resin case 8 which is mounted on an inner surface of the switch panel 3 through a metallic frame 9 which is mounted on the case 8 so as to extend upward. Opposite longitudinal edge portions of the frame 9 are bent to form flanges 10, 10' to which is fixed a reinforcing plate 11 to form a square-sleeve.

As shown in FIG. 5, the frame 9 is provided with bearing holes 12, 13 through which a shaft 14 is rotatably mounted on the frame 9 and the reinforcing plate 11. A front end portion of the shaft 14 projects forward from the frame 9 and is fixedly connected to the knob 14 in an insertion manner. A sector cam 15 is fixedly mounted on the shaft 14 so as to be moved by the shaft 14.

The sector cam 15 is made of a synthetic resin while integrally formed with the rotary plate 17 and a projection 19. The rotary plate 17 is provided with a through-hole 16 through which the rotary plate 17 is fixed to the shaft 14 so that the sector cam 15 is also fixed to the shaft 14. As a result, the sector cam 15 an be rotated by means of the knob 14 to the extent of substantially up to 90 degree.

As shown in FIG. 7, the rotary plate 17 assumes triangular shape. The projection 19 is disposed between he rotary plate 17 and the sector cam 15. The rotary late 17 is provided with: a stopper 18 which is a cylindrical projection; and a spring engaging hole 20 at its top portion. The tension spring 3 is mounted between the spring engaging hole 20 of the rotary plate 17 and the frame 9.

The projection 19 always abuts on a leaf spring 37 as shown in FIG. 3. As shown in FIG. 7, opposite edge portions of the sector cam 15 are bent to form flange sections which engage with upright nail segments formed in an inner surface of the frame 9 to limit the rotational movement range of the rotary plate 17.

The stopper 18, which rotates together with the rotary plate 17, is slidably received in an arch-like slide hole 21 formed in the reinforcing plate 11 as shown in FIGS. 3 and 4. A threaded hole 22 is provided in the stopper 18 at its portion projecting from the slide hole 21 of the reinforcing plate 11. Thereafter, the stopper 18 is further slidably received in an elongated hole 24 formed in an upper-end angle portion of the connecting rod 23 as shown in FIG. 7, and then a set-screw 26 is threadably engaged with the threaded hole 21 of the stopper 18 through a washer 25 for preventing the connecting rod 23 from dropping out of the stopper 18.

An upper-end portion of the connecting rod 23 is bent to assume a hook-like shape while provided with an intermediate portion having a longitudinal guide hole 28 in which guide pins 29, 29′ fixed to the case 8 are slidably received to permit the connecting rod 23 to slidably move up and down relative to the case 8. The connecting rod is further provided with a horizontal elongated hole 30 at its lower-end portion as shown in FIG. 6. In such horizontal elongated hole 30 is slidably received a connecting pin 31 which is fixed to a free end of the lever 32. The lever 32 is rotatably mounted on the supporting axle 33 in a lower portion of the case 8.

As shown in FIG. 9, the supporting axle 33 for supporting the lever 32 is fixed to a cam 34 mounted in the case 8 as shown in FIG. 9. The cam 34 always resiliently abuts on a movable contact plate 35 which is also mounted in the case 8. The movable contact plate 15 is oppositely disposed from a stationary contact plate 6 so as to be spaced apart from the stationary contact plate 36.

The circuit switch unit of the present invention has the above construction. Consequently, in operation, in cooking the frozen food or a normal-temperature food, the knob 14 is placed in a position "C" as shown in FIG. 1. Under such circumstances, in the switch unit mechanism, as shown in FIG. 3, the stopper 18 fixed to the rotary plate 17 is placed in a position "U" in the upper portion of the slide hole 21. Consequently, the connecting rod 23 is pulled up to its uppermost position. On the other hand, the free end engaging with the horizontal elongated hole 30 of the lower-end portion of the connecting rod 23 is placed in a position "U". The cam 34 is placed in a position shown in FIG. 9 so that the movable contact plate 35 mounted in the case 8 resiliently abuts on the stationary contact plate 36. As a result, a defrosting circuit switch unit "Df" shown in FIG. 2 is held "on" to permit the time switch "TS" to operate during the duration of the preset cooking time interval. After the collapse of such duration of the preset cooking time interval, the electric power switch of the circuit switch unit is automatically turned off.

In defrosting the frozen food, as shown in FIG. 4, the knob 4 is turned counterclockwise so as to be placed in a position "D". At this time, the rotary plate 17 is turned clockwise against the resilient force exerted by the tension spring 38, while the projection 19 is also quickly turned clockwise against the resilient force exerted by the leaf spring 37. At this time, the stopper 18 moves from the position "U" to a position "D" along the slide hole 21 and is held in the position "D". On the other hand, the connecting rod 23 engaging with the stopper 18 at its elongated hole 24 is slidably moved downward so that the connecting pin 31 engaging with the horizontal elongated hole 30 of the connecting rod 23 is also moved downward, whereby the lever 32 is turned clockwise round the supporting axle 33 so that the cam 34 fixed to the supporting axle 33 is also turned to permit the movable contact plate 35 to be separated from the stationary contact plate 36. As a result, the circuit switch unit "Df" is held "off". In this operation, a convex portion of the movable contact plate 35 is received in a concave portion of the cam 34 to make it possible that the movable contact plate 35 separates from the stationary contact plate 36 as shown in FIG. 9. Cam means (not shown) is provided in the case 8 and operated by the timer switch "TS", to make it possible that the movable contact plate 35 is intermittently operated during he duration of the time interval preset by the time witch "TS" so as to repeat the on/off operation of the electric power switch of the circuit switch unit, whereby the microwave energy is intermittently supplied to the cooking chamber of the range to conduct a defrosting treatment of the frozen food in the preset time interval.

What is claimed is:

1. A defrosting circuit switch unit for an electronic range comprising: a frame of said unit, said frame being provided with a shaft; a defrosting circuit switch lever provided in a case in which a time switch is incorporated; a connecting rod having its lower end portion connected with a free end portion of said lever, said connecting rod being slidably moved up and down; a rotary plate rotatably mounted on said frame through said shaft and provided with a stopper extending in a projecting manner, said stopper being received in an elongated hole of an upper portion of said connecting rod, said rotary plate being integrally formed with a projection and a sector cam, said projection abutting on a leaf spring mounted on said frame; and a tension spring mounted between said rotary plate and said frame so as to resiliently biasing said rotary plate, said tension spring being engaged with said rotary plate through an engaging hole provided in said rotary plate.

* * * * *